US005121665A

United States Patent [19]

Myers et al.

[11] Patent Number: 5,121,665

[45] Date of Patent: Jun. 16, 1992

[54] ADJUSTBLE CYMBAL HOLDER WITH PUSH-ON CLUTCH

[76] Inventors: Robert A. Myers, 17326 Kingsbury St., Granada Hills, Calif. 91344; Donald G. Lombardi, 2118 E. Hillcrest Dr., Tousand Oaks, Calif. 91360

[21] Appl. No.: 645,187

[22] Filed: Jan. 23, 1991

[51] Int. Cl.[5] ..... G10D 13/02

[52] U.S. Cl. ..... 84/421

[58] Field of Search ..... 84/411, 421, 422.1, 84/422.2, 422.3; 403/107, 322, 351, DIG. 8; 248/406.1, 406.2, 407, 411, 412

[56] References Cited

U.S. PATENT DOCUMENTS

| | | | |
|---|---|---|---|
| 4,365,535 | 12/1982 | Buttner et al. | 84/421 |
| 4,426,906 | 1/1984 | Otto | 84/402 |
| 4,458,574 | 7/1984 | Hoshino | 84/422.3 |
| 4,889,028 | 12/1989 | Lombardi | 84/421 |

*Primary Examiner*—L. T. Hix
*Assistant Examiner*—Howard B. Blankenship
*Attorney, Agent, or Firm*—William W. Haefliger

[57] ABSTRACT

A support for a cymbal including a first endwise elongated member defining an axis; two annular felt pads received on the member to be removable therefrom, axially; a stop on the member to seat one of the pads, axially, the stop being axially adjustable; and a retainer on the member to compressively urge the pads toward the stop, the retainer located closer to an end of the member than the stop, the retainer on the member to axially compressively urge the pads toward the stop, the retainer located closer to an end of the member than the stop, the retainer including a clutch releasably radially gripping the member; whereby a cymbal assembled between the pads receives predetermined compressive loading, axially, by the pads. The retainer typically includes a first sleeve receivable axially on the member, a clutch element carried by the sleeve for radial movement relative to the sleeve, and an actuator to urge the elements into gripping relation with the member in response to movement of the actuator relative to the sleeve.

14 Claims, 3 Drawing Sheets

FIG. 4.
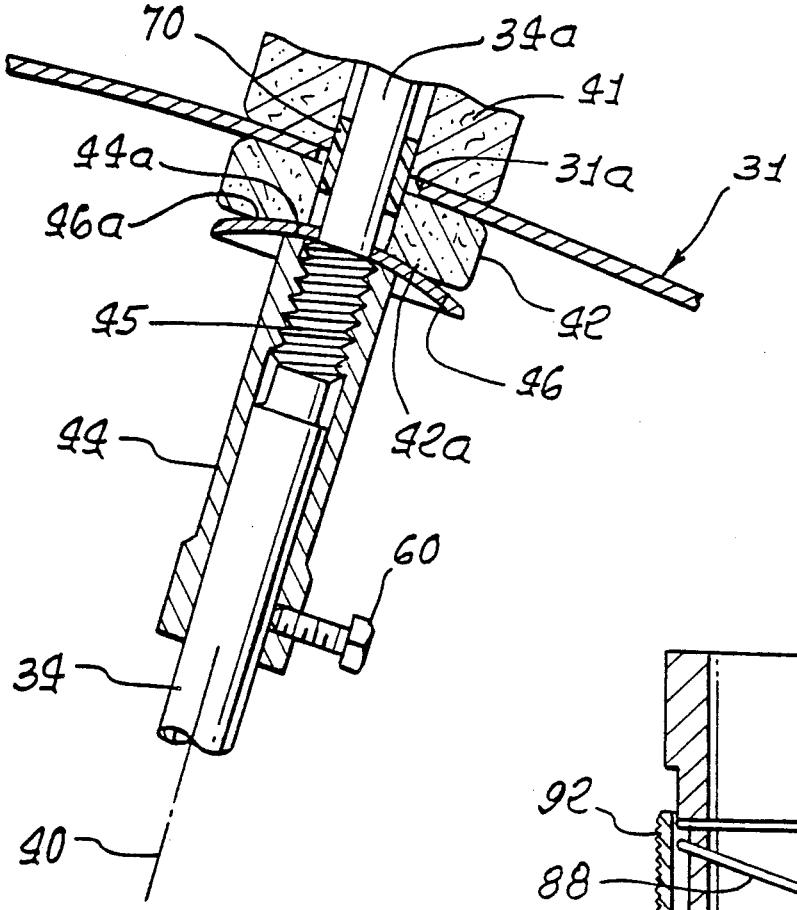
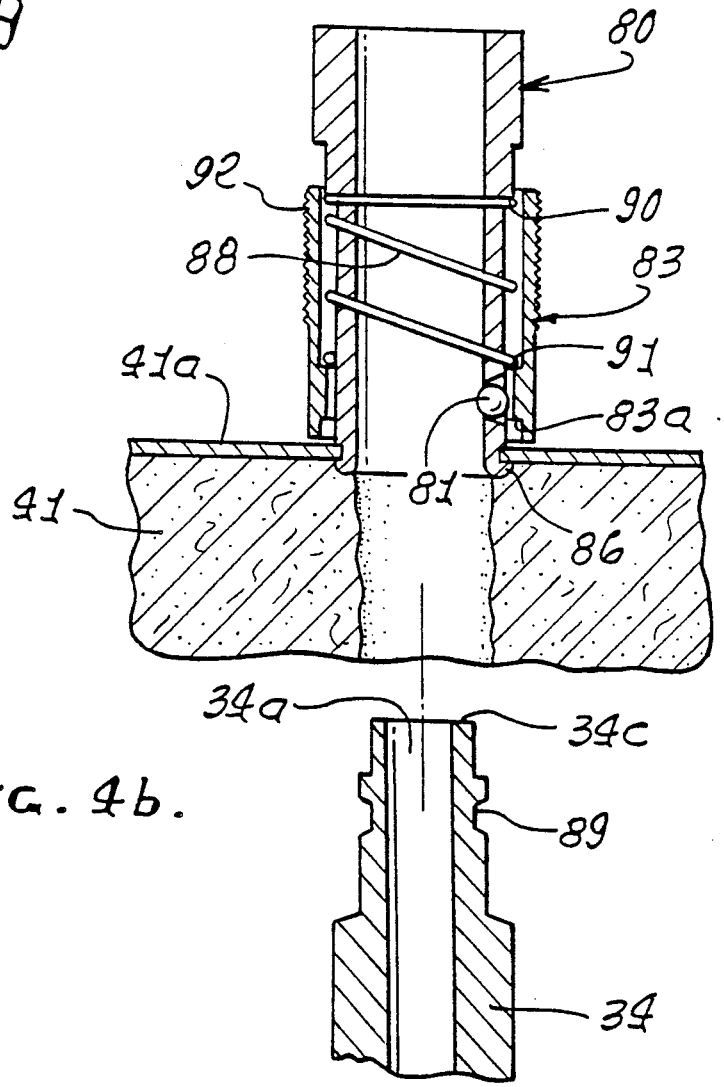
FIG. 4b.

ADJUSTBLE CYMBAL HOLDER WITH PUSH-ON CLUTCH

BACKGROUND OF THE INVENTION

This invention relates generally to cymbal support, and more particularly to a combination of components which, when assembled, provides predetermined, easily installed support for the cymbal, allowing cymbal angular displacement when struck by a drum stick.

Cymbals have been held for drummers to strike with a stick by placing them atop a stand. Specifically, the cymbal is placed over a rod and rests on a felt-supporting washer, with optional top felt washer for increasing stability when the cymbal is struck. The end of the rod is threaded to accept a nut to hold the assembly of two felts and cymbal. When the nut is tightened to secure the assembly, there is no adjustment of the space between the felts which sandwich the cymbal, thus leaving the drummer to have to have to adapt to this space which governs the cymbal swing, when struck, and the sound of the cymbal. As drummers decide to control this pace, they must skim the felt washers or use different sizes of felt; however, with usage, the felt will compress and the desired space is lost. Also, the wing nut can become lost during cymbal playing. There is need for means to automatically control the space between the felts, and in such a way that wing nut potential looseness is obviated.

SUMMARY OF THE INVENTION

It is a major object of the invention to provide means to meet the above need. Basically, the new support for a cymbal comprises, in combination:

a) a first endwise elongated member defining an axis,
b) two annular felt pads received on the member to be removable therefrom, axially,
c) stop means on the member to seat one of the pads, axially, the stop means being axially adjustable,
d) and retainer means on the member to compressively urge the pads toward the stop means, the retainer means located closer to an end of the member than the stop means, the retainer means including a clutch releasably radially gripping the member.

As will be seen, the clutch typically includes a first sleeve receivable axially on the member, a clutch element carried by the sleeve for radial movement relative to the sleeve, and actuator means to urge the elements into gripping relation with the member in response to movement of the actuator means relative to the sleeve. The member may have an annular groove presented outwardly to receive the elements.

Accordingly, the combination provides an adjustment to easily control the space between the stop means and the retainer means securing the cymbal, the retainer establishing a fixed reference when moved axially into fixed (clutching) position. The cymbal sandwiched between felts or other material takes adjustment by moving the adjustable stop toward the fixed retainer giving easy control of cymbal swing and sound, which is determined by this space.

The stop means may be in the form of a sleeve threadably mounted on the member to advance toward the pads as the sleeve is adjustably rotated; and a stop means annular flange may be received on the member between the pads and the sleeve. As will be seen, the flange is typically loosely fitted on the member, the flange having a convex surface facing and engaging one of the pads, the flange convex surface urged against the one pad by axial adjustment of the sleeve on the member.

The invention advantageously, easily and quickly establishes the retainer means in a fixed, clutching position to hold the elements assembled together. Despite this fixing of position, the stop means is adjustable, as described, to allow predetermined positioning of the felt pads to accept the cymbal so as to deflect or swing a desired amount. Wear or deterioration of the felt washers over time is thereby accommodated, without loss of desired cymbal swing or reaction, when struck by a drum stick.

These and other objects and advantages of the invention, as well as the details of an illustrative embodiment, will be more fully understood from the following specification and drawings, in which:

DRAWING DESCRIPTION

Figure 4A:
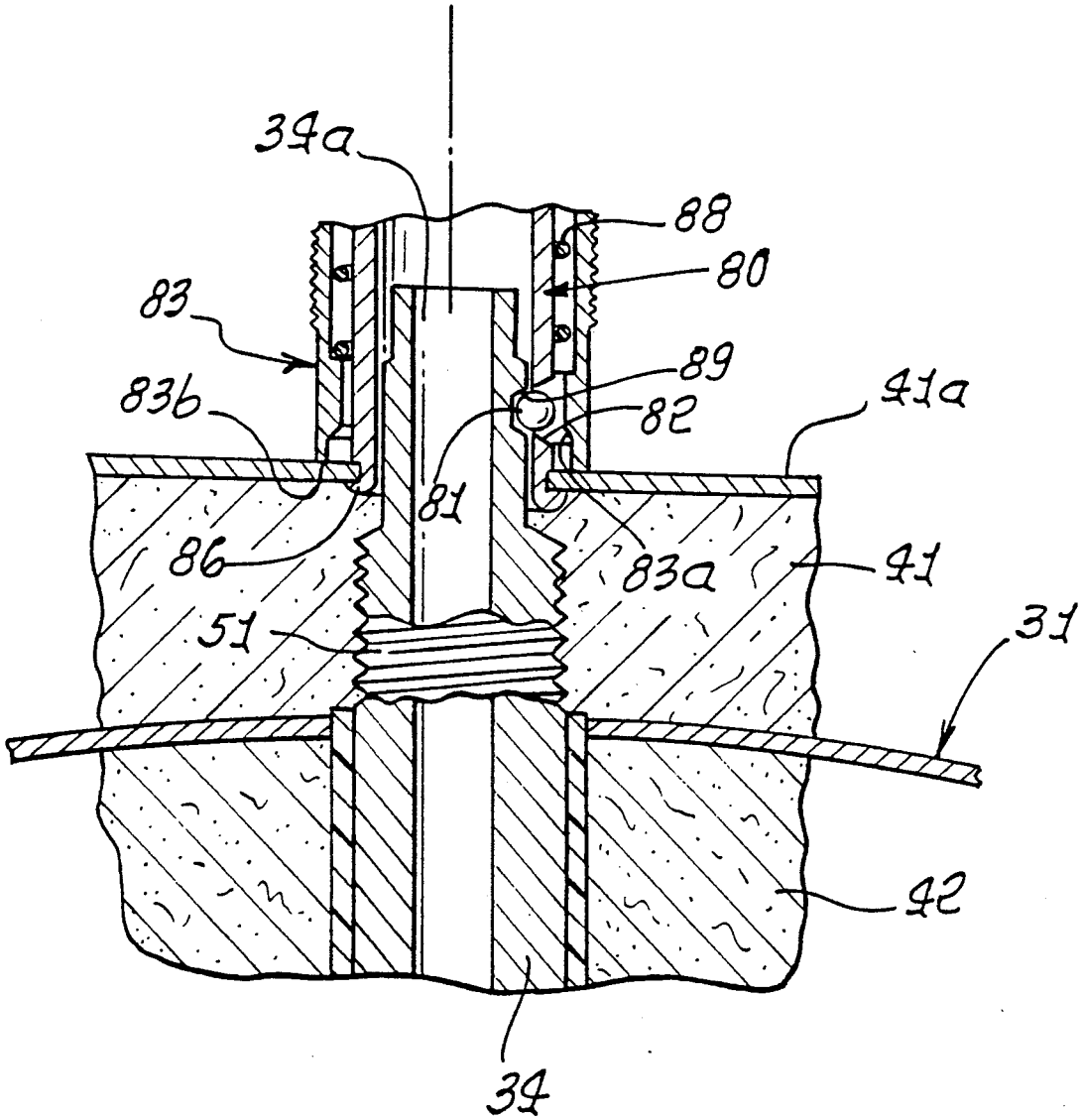
FIG. 4 is an enlarged section showing cymbal support.

FIG. 4*a* is an enlarged view, like FIG. 4, but showing a clutch releasably gripping a mounting member; and FIG. 4*b* is a view like FIG. 4*a* but showing parts prior to their assembly.

DETAILED DESCRIPTION

Figure 3:
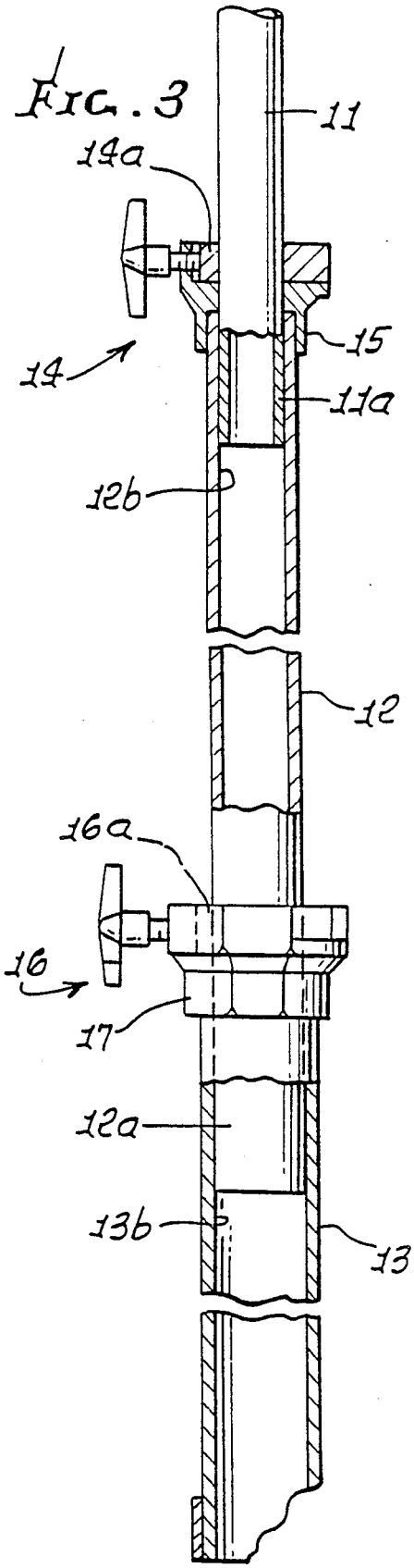
FIG. 3 is an enlarged vertical elevation.

In the drawings, a music stand 10 includes multiple telescoping sections, as for example at 11, 12 and 13. These include upper section 11 telescopically partly received in tubular middle section 12, and the middle section telescopically partly recessed within the lower section 13. See in this regard FIG. 3 showing lower portion 11*a* of section 11 telescopically received in bore 12*b* of middle section 12; and lower portion 12*a* of section 12 telescopically recessed in bore 13*b* of section 13. A clamp 14 mounted at 15 on the upper end of section 12 is manually operable to clamp a friction ring 14*a* against the side of section 11; and a clamp 16 mounted at 17 on the upper end of section 13 is manually operable to clamp a similar friction ring 16*a* against the side of section 12, thereby to retain the sections in the position shown. When the clamps are loosened, the sections are relatively telescopically movable as from collapsed position to desired extended position, as manually controlled by the musician when he sets up his equipment.

Figure 1:
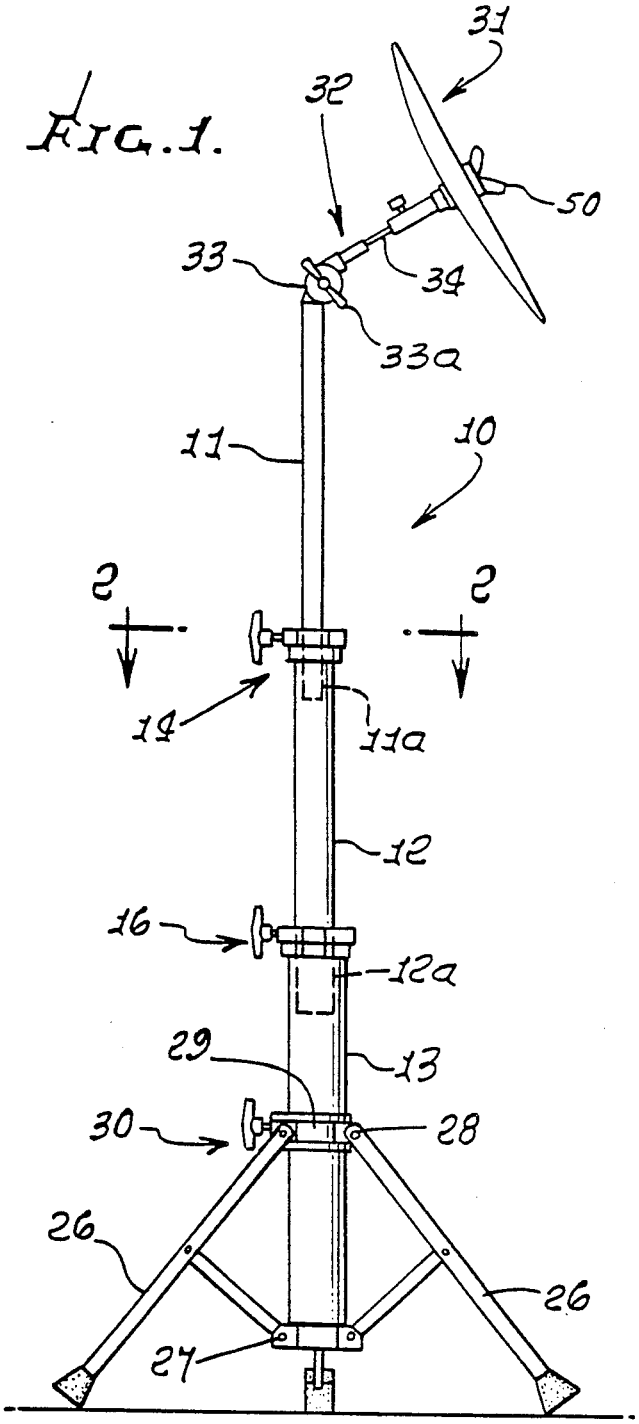
FIG. 1 is an elevation showing a music stand incorporating the invention.
Figure 2:
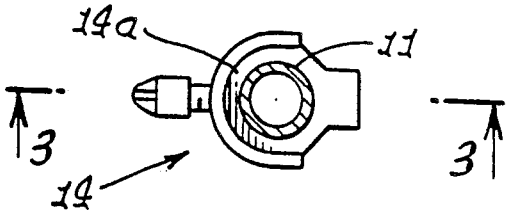
FIG. 2 is a section on FIG. 1.

FIG. 1 also shows collapsible legs 26 pivotally attached at 27 to the lower section and at 28 to a slide ring 29 on the lower section. A clamp 30 clamps the ring to the section. Also shown, merely for illustration, is a cymbal 31 adjustably attached at 32 to the upper section. See clamp 33 to adjust the angle of cymbal support rod or member 34.

Referring now to FIGS. 1 and 4, rod 34 defines a first elongated member, having an axis 40, and is swingable about the horizontal axis defined by adjustable joint 33. A wing nut 33*a* at joint 33 may be loosened to allow rod swinging, and tightened to secure it in adjusted angular position.

Two like, annular felt pads 41 and 42 are axially received endwise on the member 34, i.e., over its reduced diameter end 34*a*, to the position shown. In this process, the cymbal 31 is located between the pads. It has a central opening 31*a* to pass over the end 34*a* of the rod or member 34.

Stop means is provided on member 34 to seat one of the pads, i.e., pad 42, axially, the stop means being axially adjustable. For example, the stop means advantageously includes sleeve 4 threadably received or mounted at 45 on the rod 34, to advance endwise and controllably, toward the pads, as the sleeve is rotated. The stop means may also include a annular arcuate flange 46 loosely received on the member 34, between the pads and the sleeve. As the sleeve 44 is advanced, its end 44*a* engages the radially inner portion of the flange to displace the flange leftwardly, to a position such that the pads and cymbal are precisely located and clamped, for optimum swinging of the cymbal when struck. This is further effected by providing a convex surface 46*a* on the flange to face and engage the right face 42*a* of the pad 42, smoothly compressing it toward the cymbal extent 31*a* clamped between the pads.

Also provided is retainer means on the member 34 to compressively urge the pads toward the stop means. The retainer means is located closer to rod end 34*a* than the stop means (which is further from end 34*a* than the retainer means). A metallic retainer nut (see wing nut 50 in FIG. 1) may have threaded attachment to the rod end portion 34*b*; and when the nut is tightened, its interior shoulder may engage or bottom on the stop shoulder 34*c* on metallic member 34. At this time, the end of the nut may engage the plate or washer 41*a* adjacent the pad 41, to urge that pad toward and against the cymbal 31, clamping it loosely, but allowing cymbal swinging due to the gap between the plate 41*a* and the tapered wings of the nut. Note that the convexity of the dome-shaped flange face 46*a* also allows pivoting of pad 42 as the cymbal swings.

Note that the axial adjustability of flange 46 provides for precision clamping of the cymbal, for optimum clamping and swinging, despite the fact that the nut 50 is always tightened to the "bottoming" position shown during rapid assembly of the components as the drummer sets up his equipment for playing. This effect and result is important over time, as the felt pads wear, and leftward adjustment of the stop flange position is carried out. Once it is set, it need not be re-set each time the drmmmer sets up his equipment; and the drummer obtains optimum clamping of the cymbal simply by tightening nut 50 to the position shown. A set screw 60 may be tightened to hold sleeve 44 to member 34, when sleeve 44 has selected position. A thin, plastic sleeve 70 is located to extend closely over the member 34, inwardly of the cymbal bore 31*a* to act as a bearing as one edge of the cymbal bore works inwardly toward member 34. That sleeve may consist of TEFLON. The above features are described and claimed in U.S. Pat. No. 4,889,028 to Lombardi.

In accordance with the present invention, an alternate retainer means is provided allowing the drummer to substantially more quickly set up the cymbal stand, whereby the nut 50 is not required, and its time-consuming adjustment is therefore not required; and the problem of nut loosening during cymbal playing is not present.

As seen in FIGS. 4*a* and 4*b*, the retainer means comprises a clutch arranged to quickly and releasably grip the member 34 to establish a fixed datum or reference toward which the "stop" 44 may be initially adjustably advanced to selectively compress the pads 41 and 42 against the cymbal. Thereafter, with set screw 60 set, the set up of the cymbal merely involves push-on axial advancement of the retainer onto the end 34*a* of the shaft, until the clutch engages, to establish the datum position, as seen in FIG. 4*a*, corresponding to a condition of desired compression of the two pads 41 and 42 against opposite sides of the cymbal disc.

As shown in FIG. 4*a*, the clutch includes a first sleeve 80 telescopically receivable axially on the member 34 end portion 34*a*. One or more clutch elements, as for example one or more balls 81, is or are carried by the sleeve 80, as within radial passage or passage 82 through the sleeve wall, for radial movement toward or away from member end 34*a*. Actuator means is also provided to urge the ball or balls into gripping relation with the member end 34*a*, in response to movement of the actuator means relative to the sleeve 80. See for example the actuator means in the form of second sleeve 83 receivable axially endwise onto and over the first sleeve, and having an annular cam shoulder 83*a* to cam the ball or balls 81 radially inwardly as the sleeve 83 is moved relatively downwardly over sleeve 80 in FIG. 4*a* to the position shown, in which sleeve lower end 83*b* engages thin plate 41*a*. Note that plate 41*a* is attached to the lower end of sleeve 80, as at 86.

Yieldable means such as a compression spring 88 yieldably urges the actuator sleeve 83 downwardly to its FIG. 4*a* position. Member 34 end portion 34*a* has an annular groove 89 presented radially outwardly to receive the ball or balls, cammed inwardly as shown to lock or clutch the sleeve 80, plate 41*a* and compressible pad 41 to the member 34 in the position shown. This occurs merely by endwise push-on assembly of these parts 80, 41*a* and 41 onto 34*a*, as referred to, and obviates need for a nut to screw on to thread 51. This then removes the problem of inadvertent unthreading of such a nut; however, if the drummer 80 wishes, he can alternatively employ such a nut, and a pad 41 and plate 41*a* which are not attached to a sleeve 80 as referred to.

FIG. 4*b* shows the FIG. 4*a* elements in disassembled position. To attain this, the actuator sleeve 83 is hand gripped and retracted upwardly to further compress spring 88, and lift cam shoulder 83*a* upwardly past the ball or balls 81, allowing them to move radially outwardly to clear the groove 89, whereby the member 34 and the sleeve 80 may be relatively axially separated. See upper shoulder 90 on sleeve 80, and lower shoulder 91 on the sleeve 83, between which the opposite ends of the spring 88 are retained. See also knurl 92 on the actuator sleeve to facilitate manual grasping and sleeve elevation, as described.

We claim:

1. In a support for a cymbal, the combination comprising a) a first endwise elongated member defining an axis, b) two annular felt pads received on said member to be removable therefrom, axially, c) stop means on the member to seat one of the pads, axially, d) and retainer means on the member to axially compressively urge said pads toward the stop means, the retainer means located closer to an end of said member than said stop means, the retainer means including a clutch releasably radially gripping the member, e) whereby a cymbal assembled between said pads receives predetermined compressive loading, axially, by the pads, f) the clutch including a first sleeve receivable axially on the member, a clutch element carried by the sleeve for radial movement relative to the sleeve, and actuator means to urge said element into gripping relation with said member in response to movement of the actuator means relative to the sleeve, g) the actuator means comprising a second sleeve receivable endwise axially over the first sleeve, and yieldable means comprising a coil spring for urging said second sleeve into a position for camming said element radially inwardly toward and into said groove.

2. The combination of claim 1 wherein the retainer means is carried for movement endwise axially of said member, to a fixed position wherein the clutch radially grips the member.

3. The combination of claim 1 wherein the stop means is carried for adjustable rotation and axial advancement toward the retainer means.

4. The combination of claim 1 wherein said member has an annular groove presented outwardly to receive said element.

5. The combination of claim 4 wherein said element comprises a ball.

6. The combination of claim 1 wherein said member has an annular groove presented outwardly to receive said element.

7. The combination of claim 1 wherein one of said pads has a think plate attached thereto, and said first sleeve is attached to said thin plate.

8. The combination of claim 1 including a second elongated member which extends vertically, and a rotary adjustable joint interconnecting said first and second members.

9. The combination of claim 1 wherein said stop means includes an auxiliary sleeve threadably mounted on said member to advance toward the pads as the auxiliary sleeve is adjustably rotated.

10. The combination of claim 7 including a set screw locking the auxiliary sleeve to said member.

11. The combination of claim 9 wherein said stop means includes an annular flange received on the member between the pads and said auxiliary sleeve.

12. The combination of claim 11 wherein the flange is loosely fitted on said member, the flange having a convex surface facing and engages one of the pads, the flange convex surface urged against the one pad by axial adjustment of the sleeve on said member.

13. The combination of claim 1 including a thread on said member to alternatively receive a wing nut, to position one of said pads relative to the stop means.

14. The combination of claim 1, wherein said coil spring is confined between shoulders on said first and second sleeves.

* * * * *